US008440943B2

(12) United States Patent
Sanbongi et al.

(10) Patent No.: US 8,440,943 B2
(45) Date of Patent: May 14, 2013

(54) HEATING RESISTOR ELEMENT COMPONENT AND METHOD OF MANUFACTURING HEATING RESISTOR ELEMENT COMPONENT

(75) Inventors: Norimitsu Sanbongi, Chiba (JP); Toshimitsu Morooka, Chiba (JP); Keitaro Koroishi, Chiba (JP); Noriyoshi Shoji, Chiba (JP); Yoshinori Sato, Chiba (JP)

(73) Assignee: Seiko Instruments Inc. (JP)

( * ) Notice: Subject to any disclaimer, the term of this patent is extended or adjusted under 35 U.S.C. 154(b) by 721 days.

(21) Appl. No.: 12/589,594

(22) Filed: Oct. 26, 2009

(65) Prior Publication Data

US 2010/0122979 A1 May 20, 2010

(30) Foreign Application Priority Data

Oct. 27, 2008 (JP) ..... 2008-276055

(51) Int. Cl.
*H05B 3/02* (2006.01)

(52) U.S. Cl.
USPC ..... 219/546; 219/552

(58) Field of Classification Search ..... 219/546, 219/538–540, 542, 543, 552; 347/204, 205, 347/206; 29/611
See application file for complete search history.

(56) References Cited

U.S. PATENT DOCUMENTS 7,907,158 B2 * 3/2011 Koyama et al. ..... 347/208

FOREIGN PATENT DOCUMENTS

| | | |
|---|---|---|
| EP | 1247654 | 10/2002 |
| EP | 1780020 | 5/2007 |
| EP | 1834792 | 9/2007 |
| JP | 2007083532 | 4/2007 |

* cited by examiner

*Primary Examiner* — Hung Vu
(74) *Attorney, Agent, or Firm* — Adams & Wilks

(57) ABSTRACT

A heating resistor element component has a substrate and an adhesive layer provided on the substrate and including an adhesive and gap members arranged substantially uniformly in the adhesive. A heat storage layer is laminated on the substrate through intermediation of the adhesive layer so that the gap members maintain a distance between surfaces of the substrate and the heat storage layer constant. At least one heating resistor formed on the heat storage layer has a heating portion that generates heat. A cavity is provided in a region of the adhesive layer and interposed between the surfaces of the substrate and the heat storage layer. The cavity functions as a heat insulating layer for regulating an inflow of heat from the heat storage layer to the substrate.

19 Claims, 5 Drawing Sheets

HEATING RESISTOR ELEMENT COMPONENT AND METHOD OF MANUFACTURING HEATING RESISTOR ELEMENT COMPONENT

BACKGROUND OF THE INVENTION

1. Field of the Invention

The present invention relates to a heating resistor element component (thermal head) which is used in a thermal printer often mounted to a portable information equipment terminal typified by a compact hand-held terminal, and which is used to perform printing on a thermal recording medium based on printing data with the aid of selective driving of a plurality of heating elements, and to a manufacturing method for the heating resistor element.

2. Description of the Related Art

Recently, thermal printers have been widely used in portable information equipment terminals. The portable information equipment terminals are driven by a battery, which leads to strong demands for electric power saving of the thermal printers. Accordingly, there have been growing demands for thermal heads having high heating efficiency.

As a thermal head having high heating efficiency, one which has a structure disclosed, for example, in Patent Document (Japanese Utility Model Application Laid-open No. Sho 61-201836) is known.

However, in the thermal head disclosed in the above-mentioned Patent Document 1, cylindrical spacers are arranged directly below a heating portion (which is a portion of a resistor that actually heats and that is not overlapped with a conductor). Therefore, there is a problem that the heat generated in the heating portion escapes to a side of a ceramic substrate through the intermediation of the spacers which line-contact a glaze layer and the ceramic substrate, thereby deteriorating the heating efficiency.

Further, in the thermal head disclosed in above-mentioned Patent Document 1, the spacers are interposed in a scattered state (that is, state of being nonuniformly arranged). Therefore, there is a problem that diffusion of heat to the side of the ceramic substrate becomes nonuniform, to thereby deteriorate printing quality.

Further, in the thermal head disclosed in above-mentioned Patent Document 1, the spacers are interposed in the scattered state. Therefore, there is a risk that the spacers move when a distance between the glaze layer and the ceramic substrate is increased during use, thereby causing a problem that the spacers enter a state of being more nonuniformly arranged as time passes, and the printing quality is further deteriorated.

SUMMARY OF THE INVENTION

The present invention has been made in view of the above-mentioned circumstances, and an object thereof is therefore to provide a heating resistor element component capable of improving heating efficiency and printing quality.

For solving the above-mentioned problems, the present invention adopts the following means.

A heating resistor element component according to the present invention comprises a plurality of heating resistors arranged with intervals on a heat storage layer laminated on a supporting substrate through an intermediation of an adhesive layer, wherein:

the adhesive layer comprises an adhesive for bonding one surface of the supporting substrate and another surface of the heat storage layer together, and a plurality of gap members kneaded in the adhesive, for keeping a distance between the one surface of the supporting substrate and the another surface of the heat storage layer constant; and a cavity portion is formed in a region of the adhesive layer, the region being opposed to a heating portion of the heating resistor.

According to the heating resistor element component of the present invention, below a region covered with the heating portion of the heating resistor (region opposed to the heating portion), there is formed a cavity portion in which no gap member exists, that is, a heat regulating layer for regulating heat inflow from the heat storage layer to the supporting substrate, and hence the heating efficiency can be improved.

Further, heat dissipation to the supporting substrate side occurs through the intermediation of the gap members mixed (kneaded) evenly in the adhesive, whereby diffusion of heat is uniformed, and hence the printing quality can be improved.

Further, the gap members are retained in the adhesive, and hence even when the distance between the one surface of the supporting substrate and the another surface of the heat storage layer is increased during use, it is possible to avoid a trouble that the gap members are moved. Therefore, it is possible to prevent deterioration in printing quality due to the gap members, which enter with time into a non-uniformly arranged state.

Still further, according to the heating resistor element component of the present invention, a predetermined amount of heat dissipation occurs on the supporting substrate side by the gap members mixed evenly in the adhesive. Therefore, it is possible to prevent the adhesive from being softened due to a temperature of the heating resistors increasing from approximately 200° C. to 300° C. during operation of the heating resistor element component.

Still further, even if the adhesive is softened, the distance (interval) between the one surface of the supporting substrate and the another surface of the heat storage layer, that is, a height (or depth) of the cavity portion, is maintained to be constant (100 μm, for example) by the gap members, and hence it is possible to maintain the printing efficiency to be constantly optimum.

Still further, a pressing force applied from the surface of the heating resistor is supported by the gap members evenly mixed in the adhesive. Therefore, mechanical strength against an excessive pressure during printing can be improved, and hence durability and reliability can be improved.

It is further preferred that, in the above-mentioned heating resistor element component, the gap members be formed into spherical shapes each having the same diameter.

According to the above-mentioned heating resistor element component, each of the spherical gap members having the same diameter point-contacts with the one surface of the supporting substrate and the another surface of the heat storage layer, and hence the heat dissipation through the intermediation of the gap members can be suppressed and the heating efficiency can be further improved.

The thermal printer according to the present invention comprises the heating resistor element component having high heating efficiency.

According to the thermal printer of the present invention, printing onto thermal paper can be performed with low power, duration time of a battery can be lengthened, and the reliability of the entire printer can be improved.

A manufacturing method for a heating resistor element component according to the present invention relates to a manufacturing method for a heating resistor element component comprising a plurality of heating resistors arranged with intervals on a heat storage layer laminated on a supporting substrate through an intermediation of an adhesive layer, the manufacturing method comprising:

laminating, on one surface of the supporting substrate, the adhesive layer comprising: an adhesive for bonding the one surface of the supporting substrate and another surface of the heat storage layer together; a plurality of gap members kneaded in the adhesive, for keeping a distance between the one surface of the supporting substrate and the another surface of the heat storage layer constant; and a cavity portion formed in a region opposed to a heating portion of the heating resistor; and bonding together, after the heat storage layer is laminated on the one surface of the adhesive layer, the supporting substrate and the heat storage layer through application of a predetermined temperature and load.

A manufacturing method for a heating resistor element component according to another aspect of the present invention relates to a manufacturing method for a heating resistor element component comprising a plurality of heating resistors arranged with intervals on a heat storage layer laminated on a supporting substrate through an intermediation of an adhesive layer, the manufacturing method comprising:

laminating, on another surface of the heat storage layer, the adhesive layer comprising: an adhesive for bonding the one surface of the supporting substrate and the another surface of the heat storage layer; a plurality of gap members kneaded in the adhesive, for keeping a distance between the one surface of the supporting substrate and the another surface of the heat storage layer constant; and a cavity portion formed in a region opposed to a heating portion of the heating resistor; and bonding together, after the supporting substrate is laminated on the another surface of the adhesive layer, the supporting substrate and the heat storage layer through application of application of a predetermined temperature and load.

According to the manufacturing method for a heating resistor element component according to the present invention, even when a predetermined load is applied when bonding (adhering) the supporting substrate and the heat storage layer, a distance (interval) between the one surface of the supporting substrate and the another surface of the heat storage layer is maintained to be constant (100 μm, for example) by the gap members having the same height (or the same diameter). Therefore, it is possible to form the cavity portion so as to have a predetermined height or depth (100 μm, for example).

According to the present invention, it is possible to provide the effect of improving the heating efficiency and the printing quality.

DETAILED DESCRIPTION OF THE PREFERRED EMBODIMENT

Hereinafter, description is made of an embodiment of a heating resistor element component according to the present invention with reference to FIGS. 1 to 10.

Figure 1:
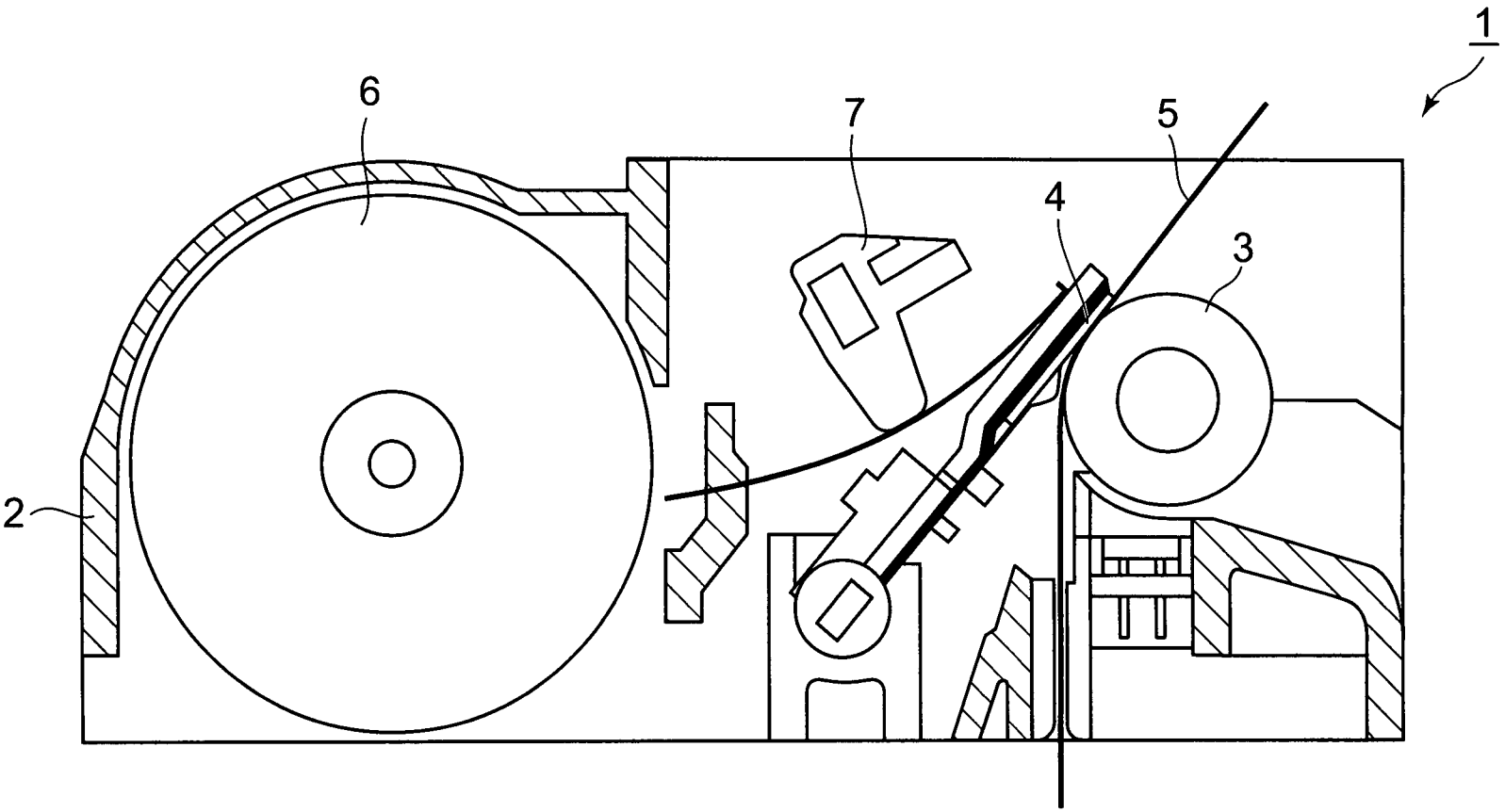
FIG. 1 is a longitudinal sectional view of a thermal printer in which a thermal head according to the present invention is installed.
Figure 2:
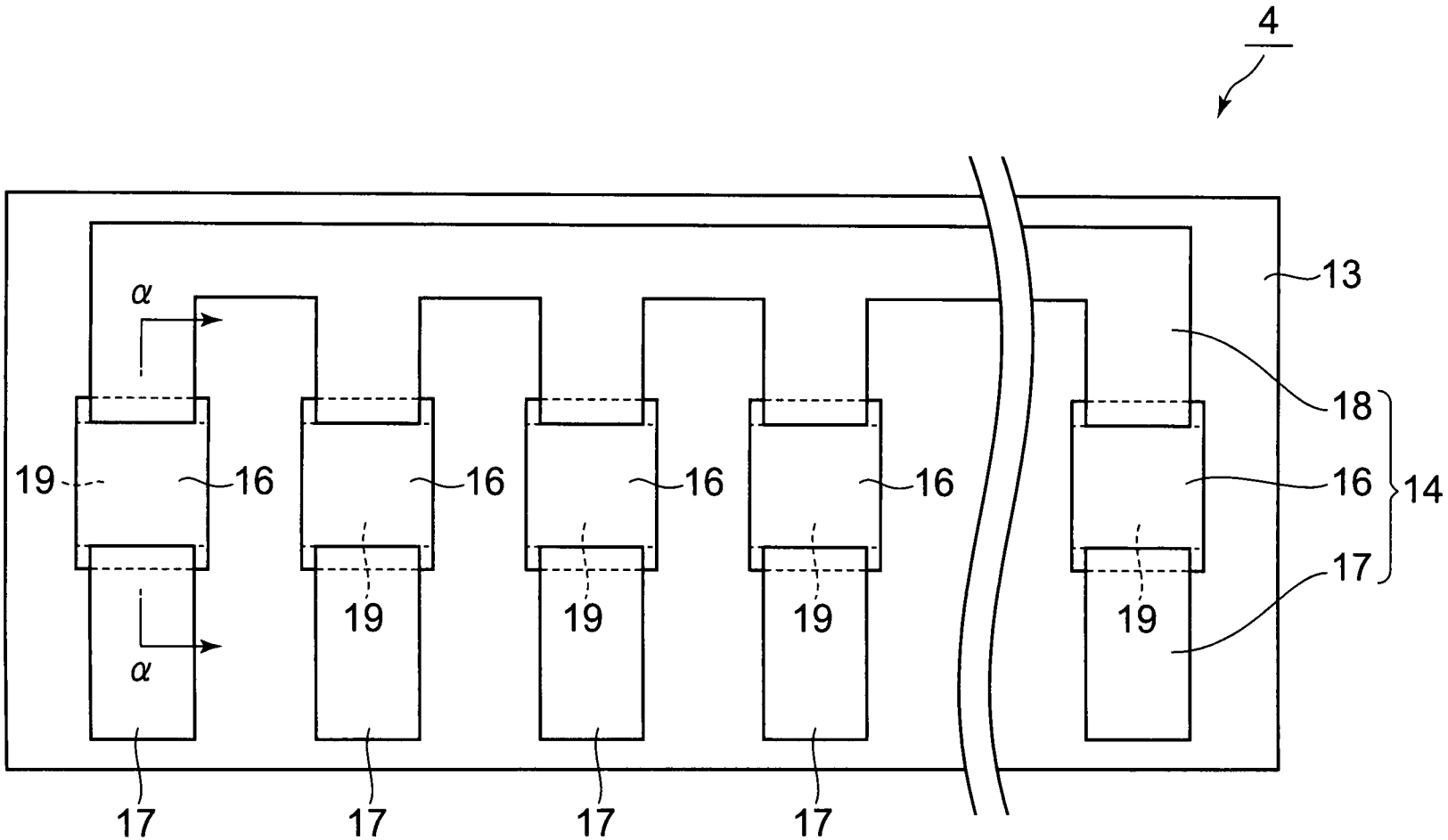
FIG. 2 is a plane view of the thermal head according to an embodiment of the present invention, illustrating a state in which a protective film is removed.
Figure 3:
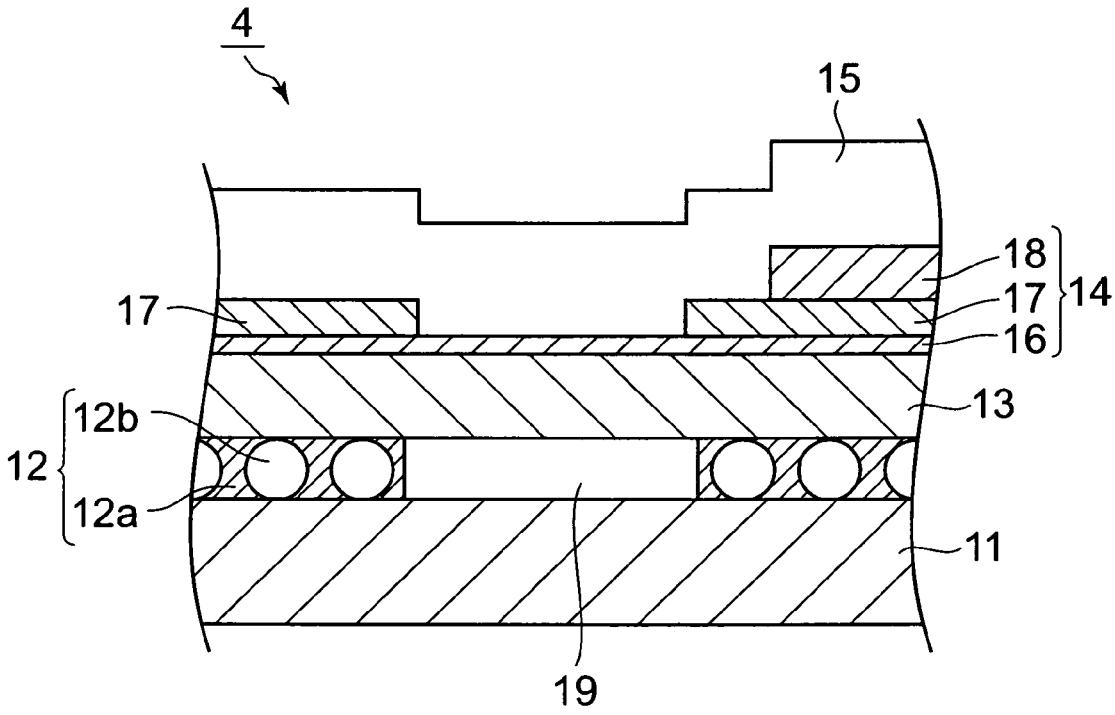
FIG. 3 is a sectional view taken along the arrow α-α of FIG. 2.

FIG. 1 is a longitudinal sectional view of a thermal printer in which the heating resistor element component (hereinafter, referred to as "thermal head") of the present invention is installed. FIG. 2 is a plane view of the thermal head according to this embodiment, illustrating a state of eliminating a protective film. FIG. 3 is a sectional view taken along the arrow α-α of FIG. 2. FIGS. 4 to 10 are process diagrams for illustrating a manufacturing method for the thermal head according to this embodiment.

As illustrated in FIG. 1, a thermal printer 1 includes a main body frame 2, a platen roller 3 horizontally arranged, a thermal head 4 arranged oppositely to an outer peripheral surface of the platen roller 3, a paper feeding mechanism 6 for feeding out thermal paper 5 between the platen roller 3 and the thermal head 4, and a pressure mechanism 7 for pressing the thermal head 4 against the thermal paper 5 by a predetermined pressing force.

As illustrated in FIG. 2 or 3, the thermal head 4 includes a supporting substrate (hereinafter, referred to as "substrate") 11 and a heat storage layer 13 bonded onto one surface (upper surface in FIG. 3) of the substrate 11 through the intermediation of an adhesive layer 12 formed in a predetermined pattern. Further, on one surface (upper surface in FIG. 3) of the heat storage layer 13, a plurality of heating resistors 14 are formed (arranged) with intervals in one direction. Further, as illustrated in FIG. 3, the thermal head 4 has a protective film 15 covering the heat storage layer 13 and one surfaces (upper surfaces in FIG. 3) of the heating resistors 14 to protect them from abrasion and corrosion.

Note that, on another surface (lower surface in FIG. 3) of the substrate 11, there is provided a heat dissipation plate (not shown).

Each of the heating resistors 14 includes a heating resistor layer 16 formed on one surface of the heat storage layer 13 in a predetermined pattern, an individual electrode 17 formed on one surface (upper surface in FIG. 3) of the heating resistor layer 16 in a predetermined pattern, and a common electrode 18 formed on one surface (upper surface in FIG. 3) of the individual electrode 17 in a predetermined pattern.

It is noted that an actually heating portion of each of the heating resistors 14 (hereinafter, referred to as "heating portion") is a portion not overlapped with the individual electrode 17 and the common electrode 18.

As illustrated in FIGS. 2 and 3, cavity portions (hollow heat insulating layers) 19 are formed in the adhesive layer 12.

Each of the cavity portions 19 is a space formed below a region covered with the heating portion of each of the heating resistors 14 (region opposed to the heating portion), that is, a space formed (enclosed) by the one surface of the substrate 11, the another surface (lower surface in FIG. 3) of the heat storage layer 13, and wall surfaces (surfaces orthogonal to the one surface of the substrate 11 and the another surface of the heat storage layer 13) of the adhesive layer 12. Further, a gas layer in each of the cavity portions 19 functions as a heat insulating layer for regulating heat inflow from the heat storage layer 13 to the substrate 11.

Note that, a dimension of the cavity portion 19 in plane view is arbitrary. As long as it is near the dimension of the heating portion, the dimension may be larger than that of the heating portion as in this embodiment, or may be smaller than that of the heating portion.

The adhesive layer 12 includes an adhesive 12*a* for bonding the one surface of the substrate 11 and the another surface of the heat storage layer 13, and gap members 12*b* arranged substantially uniformly in the adhesive 12*a*, for keeping constant (100 μm, for example,) a thickness of the adhesive layer 12 (or height or depth of the cavity portion 19), that is, a distance (interval) between the one surface of the substrate 11 and the another surface of the heat storage layer 13.

As a material for the adhesive 12*a*, there is used a high heat-resistance material capable of withstanding a temperature of the heating resistors 14 increasing approximately from 200° C. to 300° C., such as glass paste containing silicon dioxide, boron oxide, or the like as a main component, and a polymer resin material such as a polyimide resin, an epoxy resin, or the like.

The gap members 12*b* are spherical members having a diameter of, for example, 100 μm, and dispersed in the proportion of several members to approximately ten members per 1 $mm^2$. As a material for the gap members 12*b*, for example, nylon, acryl, phenol, silicone, benzoguanamine-.melamine, polyethylene, cellulose, ultrahigh molecular weight polyolefin (PE), a fluororesin, a PAN (polyacrylonitrile)-based, styrene, acryl-styrene-based resin materials, and inorganic materials such as glass, silica, alumina, boron nitride, magnesia, aluminum nitride, and silicon nitride are used.

Next, description is made, with reference to FIGS. 4 to 10, of a manufacturing method for the thermal head 4 according to this embodiment.

Figure 4:
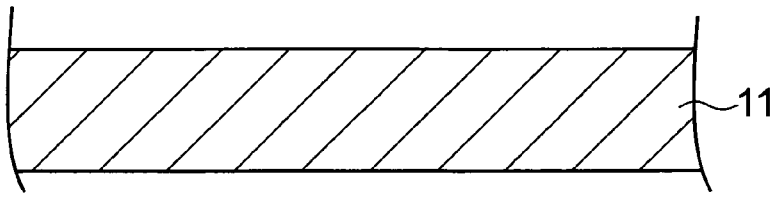
FIG. 4 is a process diagram illustrating a manufacturing method for the thermal head according to the embodiment of the present invention.
Figure 5:
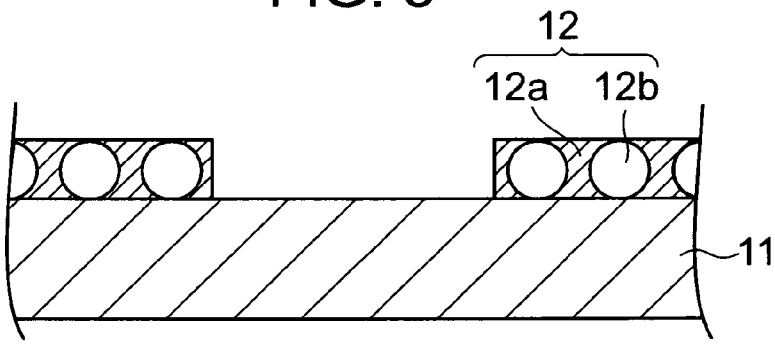
FIG. 5 is a process diagram illustrating the manufacturing method for the thermal head according to the embodiment of the present invention.

First, as illustrated in FIG. 4, the substrate 11 having a constant (approximately 300 μm to 1 mm) thickness is prepared. Then, as illustrated in FIG. 5, on the one surface of the substrate 11, there is screen-printed the paste-like adhesive layer 12 which has been kneaded in advance so that the plurality of gap members 12*b* are dispersed substantially uniformly in the adhesive 12*a*.

Figure 6:
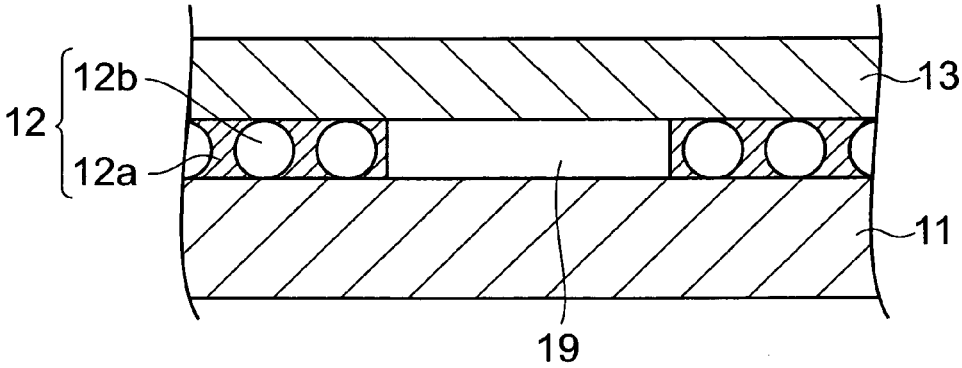
FIG. 6 is a process diagram illustrating the manufacturing method for the thermal head according to the embodiment of the present invention.
Figure 7:
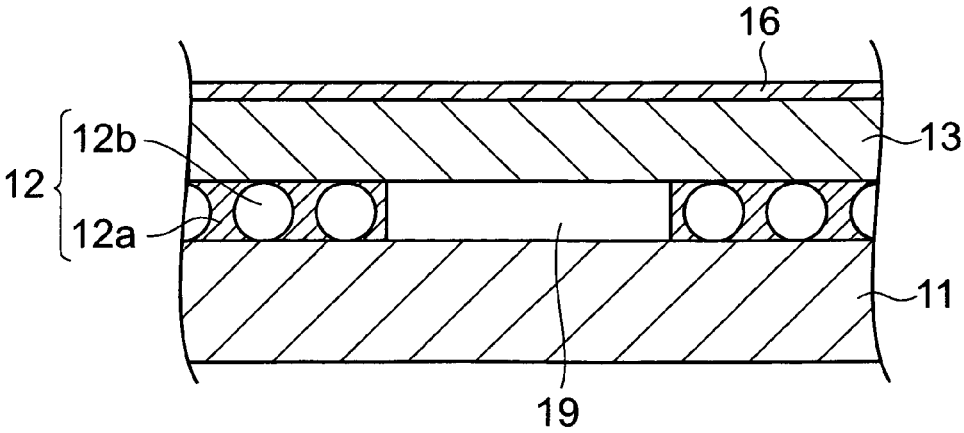
FIG. 7 is a process diagram illustrating the manufacturing method for the thermal head according to the embodiment of the present invention.
Figure 8:
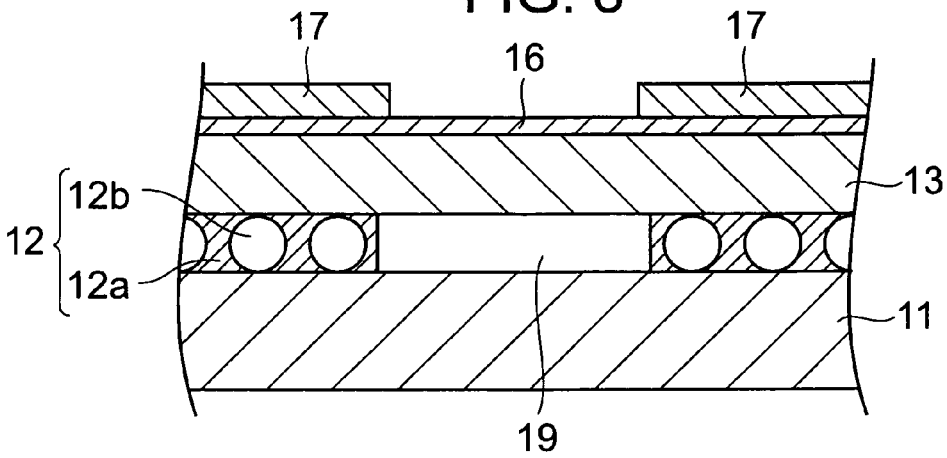
FIG. 8 is a process diagram illustrating the manufacturing method for the thermal head according to the embodiment of the present invention.
Figure 9:
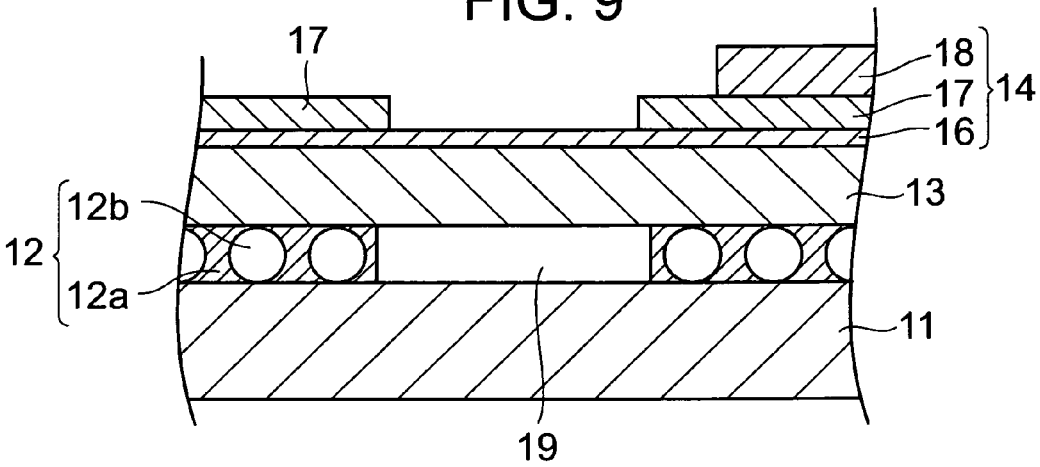
FIG. 9 is a process diagram illustrating the manufacturing method for the thermal head according to the embodiment of the present invention.
Figure 10:
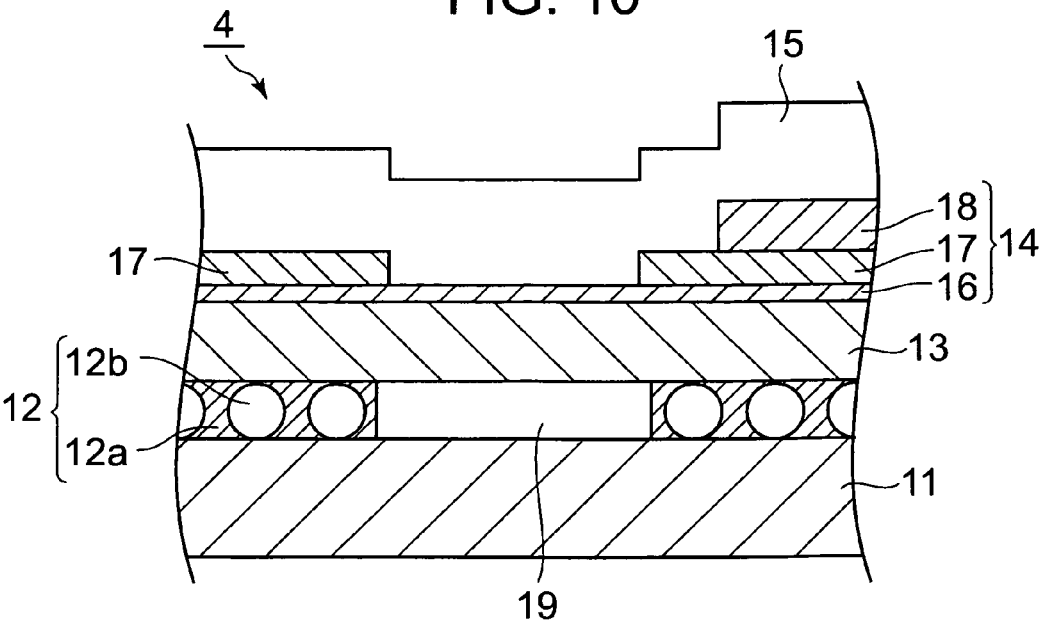
FIG. 10 is a process diagram illustrating the manufacturing method for the thermal head according to the embodiment of the present invention.

Next, as illustrated in FIG. 6, on the one surface (upper surface in FIG. 6) of the paste-like adhesive layer 12, the heat storage layer 13 having a constant (approximately 5 μm to 100 μm) thickness is placed, and a predetermined load is applied thereon uniformly at a predetermined temperature for a certain period of time, to thereby bond (adhere) the substrate 11 and the heat storage layer 13 together. As a material for the heat storage layer 13, for example, glass, a resin, or the like is used.

Then, on the heat storage layer 13 formed as described above, the heating resistor layer 16 (see FIG. 7), individual wires 17 (see FIG. 8), a common wire 18 (see FIG. 9), and the protective film 15 (see FIG. 10) are sequentially formed. Note that, the order of forming the heating resistor layer 16, the individual wires 17, and the common wire 18 is arbitrary.

The heating resistor layer 16, the individual wires 17, the common wire 18, and the protective film 15 can be manufactured by using a manufacturing method for those members of a conventional thermal head. Specifically, a thin film formation method such as sputtering, chemical vapor deposition (CVD), or vapor deposition is used to form a thin film made of a Ta-based or silicide-based heating resistor material on the insulating film. Then, the thin film made of the heating resistor material is molded by lift-off, etching, or the like, whereby the heating resistor having a desired shape is formed.

Similarly, the film formation with use of a wiring material such as Al, Al—Si, Au, Ag, Cu, and Pt is performed on the heat storage layer 13 by using sputtering, vapor deposition, or the like. Then, the film thus obtained is formed by lift-off or etching, or the wiring material is screen-printed and is burned thereafter, to thereby form the individual wires 17 and the common wire 18 which have the desired shapes.

After the formation of the heating resistor layer 16, the individual wires 17, and the common wire 18, the film formation with use of a protective film material such as $SiO_2$, $Ta_2O_5$, SiAlON, $Si_3N_4$, or diamond-like carbon is performed on the heat storage layer 13 by sputtering, ion plating, CVD, or the like, whereby the protective film 15 is formed.

According to the thermal head 4 and the manufacturing method therefor according to this embodiment, below a region covered with the heating portion of the heating resistor 14 (region opposed to the heating portion), there is formed a cavity portion 19 in which no gap member 12*b* exists, that is, a heat insulating layer for regulating heat inflow from the heat storage layer 13 to the substrate 11. Therefore, heating efficiency can be improved.

Further, heat dissipation to the substrate 11 side occurs through the intermediation of the gap members 12*b* evenly mixed in the adhesive 12*a*, and hence diffusion of heat is uniformed. Therefore, printing quality can be improved.

Further, the gap members 12*b* are retained in the adhesive 12*a*. Therefore, even when the distance between the one surface of the substrate 11 and the another surface of the heat storage layer 13 is increased during use, it is possible to avoid a trouble that the gap members 12*b* are moved, and hence it is possible to prevent deterioration in printing quality due to the gap members 12*b* entering a nonuniformly arranged state as time passes.

Further, according to the thermal head 4 in this embodiment, by the gap members 12*b* evenly mixed in the adhesive 12*a*, a predetermined amount of heat dissipation to the substrate 11 side occurs. Therefore, it is possible to prevent the adhesive 12*a* from being softened due to the temperature of the heating resistors 14 increasing approximately from 200° C. to 300° C. during operation of the thermal head 4.

Further, even if the adhesive 12*a* is softened, the distance (interval) between the one surface of the substrate 11 and the another surface of the heat storage layer 13, that is, the height (or depth) of the cavity portion 19 is maintained to be constant (100 μm, for example) by the gap members 12*b*, and hence the printing efficiency can be maintained to be optimum constantly.

Further, by the gap members 12*b* evenly mixed in the adhesive 12*a*, the pressing force applied from the surface (upper surface in FIG. 3) of the heating resistors 14 is supported. Therefore, it is possible to improve a mechanical strength against an excessive pressure at the time of printing, and durability and reliability can be improved.

Still further, the gap members 12*b* are formed into spherical shapes having the same diameter, and the structure is provided such that the surfaces of the gap members 12*b* point-contact with the one surface of the substrate 11 and the another surface of the heat storage layer 13. Therefore, it is possible to inhibit the heat dissipation through the intermediation of the gap members 12*b*, and hence it is possible to further improve the heating efficiency.

Note that, thermal conductivity of glass is 0.9 W/mK, thermal conductivity of air is 0.02 W/mK, and thermal conductivity of an epoxy resin is 0.21 W/mK.

Further, according to the thermal printer 1 in which the thermal head 4 according to this embodiment is installed, because the thermal head 4 having high heating efficiency is provided, it is possible to perform printing onto the thermal paper 5 with low power. Therefore, it is possible to lengthen duration time of a battery.

On the other hand, according to the manufacturing method for the thermal head 4 according to this embodiment, even when a predetermined load is applied when bonding (adhering) the substrate 11 and the heat storage layer 13, the distance (interval) between the one surface of the substrate 11 and the another surface of the heat storage layer 13 are maintained to be constant (100 μm, for example) by the gap members 12*b* having the same height (or the same diameter). Therefore, it is possible to form the cavity portions 19 so as to have a predetermined height or depth (100 μm, for example).

Note that, the thermal head according to the present invention is not limited to that in the above-mentioned embodiment, and can be appropriately deformed, modified, and combined as needed.

For example, in the above-mentioned embodiment, the cavity portions 19 are formed by the same number as that of the heating resistors 14. However, the present invention is not limited thereto, and the cavity portions 19 may be formed so as to straddle the heating resistors 14 along the arrangement direction of the heating resistors 14, that is, one cavity portion may be formed.

According to the thermal head in which the above-mentioned cavity portions are formed, the cavity portions arranged adjacently to each other are communicated, and hence part of a flow-out path into the substrate 11 of the heat (amount of heat) generated in the heating resistors 14 is blocked. Therefore, it is possible to further suppress flowing out of the heat (amount of heat) generated in the heating resistors 14 into the substrate 11, thereby further improving the heating efficiency of the heating resistors 14 to further achieve a reduction in power consumption.

Further, in the above-mentioned embodiment, description is made of the thermal head 4 and the thermal printer 1 performing thermo-autochrome color development. However, the present invention is not limited thereto, and can be applied to a heating resistor element component other than the thermal head 4, and a printer device other than the thermal printer 1.

For example, as the heating resistor element component, uses such as a thermal type or bulb type inkjet head which discharges ink by heat are applicable. Further, the same effects can be obtained in a thermal erase head having substantially the same structure as that of the thermal head 4, a fixing heater for a printer or the like which needs heat fixing, and an electronic component including other film-like heating resistor element components such as a thin film heating resistor element of an optical wave guide optical component and the like.

Further, as the printer, a thermal transfer printer using a sublimation-type or fusing-type transfer ribbon, a rewritable thermal printer capable of color-developing and evidencing of a printing medium, a thermal active adhesive-type label printer exhibiting adhesiveness by heating, and the like are applicable.

What is claimed is:

1. A heating resistor element component comprising: a supporting substrate, an adhesive layer provided on the supporting substrate, a heat storage layer laminated on the supporting substrate through intermediation of the adhesive layer, a plurality of heating resistors arranged at intervals on the heat storage layer, and a cavity portion interposed between surfaces of the supporting substrate and the heat storage layer and formed in a region of the adhesive layer that is opposed to a heating portion of the heating resistors, the adhesive layer comprising an adhesive for bonding the surfaces of the supporting substrate and the heat storage layer together and a plurality of gap members kneaded in the adhesive for maintaining a distance between the surfaces of the supporting substrate and the heat storage layer constant.

2. A heating resistor element component according to claim 1; wherein the gap members are formed into spherical shapes each having the same diameter.

3. A thermal printer comprising a thermal head having the heating resistor element component according to claim 2.

4. A thermal printer comprising a thermal head having the heating resistor element component according to claim 1.

5. A heating resistor element according to claim 1; wherein none of the plurality of gap members of the adhesive layer exists in the cavity portion.

6. A heating resistor element according to claim 1; wherein each of the plurality of gap members is in point contact with the surfaces of the supporting substrate and the heat storage layer.

7. A heating resistor element according to claim 6; wherein each of the plurality of gap members is spherical-shaped.

8. A manufacturing method for a heating resistor element component, comprising:

a first laminating step of laminating on a surface of one of a supporting substrate and a heat storage layer an adhesive layer comprising an adhesive, a plurality of gap members kneaded in the adhesive, and a cavity portion;

a second laminating step of laminating the other of the supporting substrate and the heat storage layer on the adhesive layer so that the plurality of gap members of the adhesive layer maintain a constant distance between surfaces of the supporting substrate and the heat storage layer with the cavity portion of the adhesive layer interposed therebetween;

bonding together the supporting substrate and the heat storage layer through application thereon of a predetermined load at a predetermined temperature; and forming a heating resistor on the heat storage layer bonded to the supporting substrate so that the cavity portion of the adhesive layer is disposed in a region opposed to a heating portion of the heating resistor.

9. A method according to claim 8; wherein the first laminating step comprises laminating the adhesive layer on the surface of the supporting substrate; and wherein the second laminating step comprises laminating the heat storage layer on the adhesive layer.

10. A method according to claim 8; wherein the first laminating step comprises laminating the adhesive layer on the surface of the heat storage layer; and wherein the second laminating step comprises laminating the supporting substrate on the adhesive layer.

11. A method according to claim 8; wherein none of the plurality of gap members exists in the cavity portion.

12. A method according to claim 8; wherein in the second laminating step, the plurality of gap members of the adhesive layer maintain a constant distance between surfaces of the supporting substrate and the heat storage layer while each of the plurality of gap members is in point contact with the surfaces of the supporting substrate and the heat storage layer.

13. A method according to claim 12; wherein each of the plurality of gap members is spherical-shaped.

14. A heating resistor element component comprising:

a substrate;

an adhesive layer provided on the substrate, the adhesive layer comprising an adhesive and a plurality of gap members arranged substantially uniformly in the adhesive;

a heat storage layer laminated on the substrate through intermediation of the adhesive layer so that the plurality of gap members maintain a distance between surfaces of the substrate and the heat storage layer constant;

at least one heating resistor formed on the heat storage layer, the at least one heating resistor having a heating portion that generates heat; and a heat insulating layer formed in a region of the adhesive layer and interposed between the surfaces of the substrate and the heat storage layer for regulating an inflow from the heat storage layer to the substrate of the heat generated by the heating portion of the at least one heating resistor.

15. A heating resistor element component according to claim 14; wherein none of the plurality of gap members of the adhesive layer exists in the heat insulating layer.

16. A heating resistor element according to claim 14; wherein each of the plurality of gap members is in point contact with the surfaces of the supporting substrate and the heat storage layer.

17. A heating resistor element according to claim 16; wherein the plurality of gap members are spherical-shaped and have the same diameter.

18. A thermal printer comprising a thermal head having the heating resistor element component according to claim 17.

19. A thermal printer comprising a thermal head having the heating resistor element component according to claim 14.

* * * * *